US005182694A

United States Patent [19]

Endo

[11] Patent Number: 5,182,694

[45] Date of Patent: Jan. 26, 1993

[54] CORONA DISCHARGING APPARATUS WITH AUTOMATIC CLEANING MECHANISM FOR CORONA WIRE

[75] Inventor: Michiaki Endo, Yokohama, Japan

[73] Assignee: Canon Kabushiki Kaisha, Tokyo, Japan

[21] Appl. No.: 591,266

[22] Filed: Oct. 1, 1990

[30] Foreign Application Priority Data

Sep. 29, 1989 [JP] Japan ..... 1-252438

[51] Int. Cl.[5] ..... G03G 21/00

[52] U.S. Cl. ..... 361/229; 355/296

[58] Field of Search ..... 361/229, 230, 231, 233, 361/214; 250/324-326; 355/221-225, 296

[56] References Cited

U.S. PATENT DOCUMENTS

| | | | |
|---|---|---|---|
| 3,978,379 | 8/1976 | DelVecchio | 361/229 |
| 4,038,546 | 7/1977 | Jasinski | 250/324 |
| 4,864,363 | 9/1989 | Shinada | 355/133 |
| 4,885,466 | 12/1989 | Koichi et al. | 250/324 |
| 4,956,671 | 9/1990 | Otsuka | 355/215 |
| 5,023,748 | 6/1991 | Okamoto et al. | 361/229 |

*Primary Examiner*—A. D. Pellinen
*Assistant Examiner*—David Osborn
*Attorney, Agent, or Firm*—Fitzpatrick, Cella, Harper & Scinto

[57] ABSTRACT

The present invention provides a corona discharging apparatus with an automatic cleaning mechanism for a corona wire comprising a plurality of sets of cleaning units, one of which having an L-shaped cleaning member made of elastic material. The cleaning members are abutted against a surface of the corona wire from different directions to effectively clean the corona wire.

28 Claims, 4 Drawing Sheets

CORONA DISCHARGING APPARATUS WITH AUTOMATIC CLEANING MECHANISM FOR CORONA WIRE

BACKGROUND OF THE INVENTION

1. Field of the Invention

The present invention relates to an automatic cleaning apparatus for a charger of an image forming system using the electrophotography, such as a copying machine, printer and like.

2. Related Background Art

Arranged around a photosensitive drum acting as an image bearing member of a copying machine, there are, for example, primary charger for uniformly charging the photosensitive drum, a transfer charger for transferring a toner image formed on the photosensitive drum onto a transfer sheet or recording medium, and the like.

The charger, such as the primary charger and the transfer charger has a corona wire(s) disposed in a space enclosed by a shield, and serves to generate the corona discharge directing toward the photosensitive drum by supplying the voltage to the corona wire, thereby applying the positive or negative charges to the photosensitive drum.

If the toner, oil mist dust or the like, existing in the system, has adhered to the corona wire, the correct discharge is disturbed, thereby making the formation of the proper image difficult. Thus, it is necessary to clean or remove the stains that have adhered to the corona wire.

In general, as shown in FIG. 4, a charger has an automatic cleaning apparatus comprising a pair of cleaning members 101 between which a corona wire 100 is held and which can slide along the corona wire 100 to clean the latter.

However, when the corona wire 100 is held or sandwiched between the cleaning members 101, spaces 103 are created around the corona wire 100 between the contacted surfaces 102 of the cleaning members, i.e., there arise areas where the cleaning members 101 and the corona wire 100 do not contact with each other. Accordingly, as shown in FIG. 5A, if the stains 110 are adhered around the corona wire 100, even after the corona wire 100 has been cleaned by the cleaning members 101, a portion of the stains 110 will remain on the corona wire 100, as shown in FIG. 5B. Consequently, the formation of the proper image cannot be effected by the charger having such a corona wire.

SUMMARY OF THE INVENTION

The present invention aims to solve the abovementioned conventional problem, and an object of the present invention is to provide a corona discharging apparatus with an automatic cleaning mechanism which can clean or remove the stains from substantially the whole peripheral surface of the corona wire.

In order to achieve the above object, a corona discharging apparatus with an automatic cleaning mechanism for a corona wire of the present invention comprises a plurality of sets of cleaning units, each set having a support member for supporting a cleaning member made of elastic material; a supporting means for simultaneously supporting the plurality of sets of cleaning units in such a manner that the cleaning members are abutted against a surface of the corona wire from different directions and cooperate to sweep a peripheral surface of the corona wire; a driving force transmitting means for transmitting a driving force to the supporting means; and a guide means for guiding the supporting means being subjected to the driving force along the corona wire.

DETAILED DESCRIPTION OF THE PREFERRED EMBODIMENT

The present invention will now be explained in connection with an embodiment of the invention applied to a copying machine with reference to the accompanying drawings.

Figure 1:
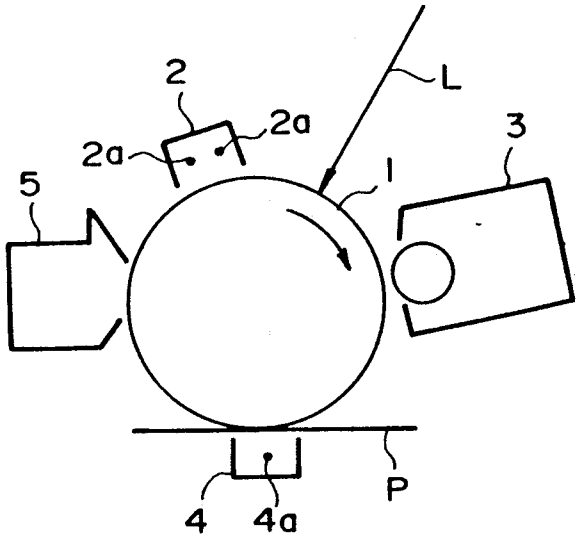
FIG. 1 is a schematic side view of an image forming system, for explaining an operation thereof.

First of all, a summary of an image forming operation of the copying machine will be described with reference to FIG. 1. In FIG. 1, around a photosensitive drum 1 forming an image bearing member, there are disposed a primary charger 2, a developing device 3, a transfer charger 4 and a cleaning device 5. When image light L from an original (not shown) is illuminated on the photosensitive drum 1 which is uniformly charged by the primary charger 2, an electrostatic latent image is formed on the photosensitive drum 1 in accordance with the information of the image light L. The latent image is moved toward the developing device 3 as the drum 1 is rotated and is developed by toner in the developing device to be changed to a toner image.

The toner image is transferred, by means of the transfer charger 4, onto a transfer sheet (recording medium) P fed from a sheet supplying system (not shown). Then, the transfer sheet P carrying the toner image thereon is fed to a fixing device (not shown), where the toner image is fixed to the transfer sheet as a permanent image. Meanwhile, the residual toner attached to the photosensitive drum 1, after the transfer of the toner image has been finished, is removed from the drum by the cleaning device 5. The cycles are repeated until a desired number of copies are obtained.

In the primary charger 2 and the transfer charger 4, the corona discharge directing toward the photosensitive drum 1 is generated by applying the voltage to corona wires 2*a* and 4*a* which are enclosed by their respective shields, thus supplying the positive or negative charges to the photosensitive drum 1. If the toner, oil mist, dust and the like existing in the copying machine has adhered to the corona wires 2*a* and 4*a* of the chargers 2, 4, the normal or correct discharge cannot be obtained, and thus, the chargers cannot perform their functions adequately. Therefore, generally in many cases, the charger has an automatic cleaning mechanism for cleaning the corona wire.

Now, an automatic cleaning mechanism of the primary charger 2 will be described with reference to FIGS. 2 and 3.

Figure 2:
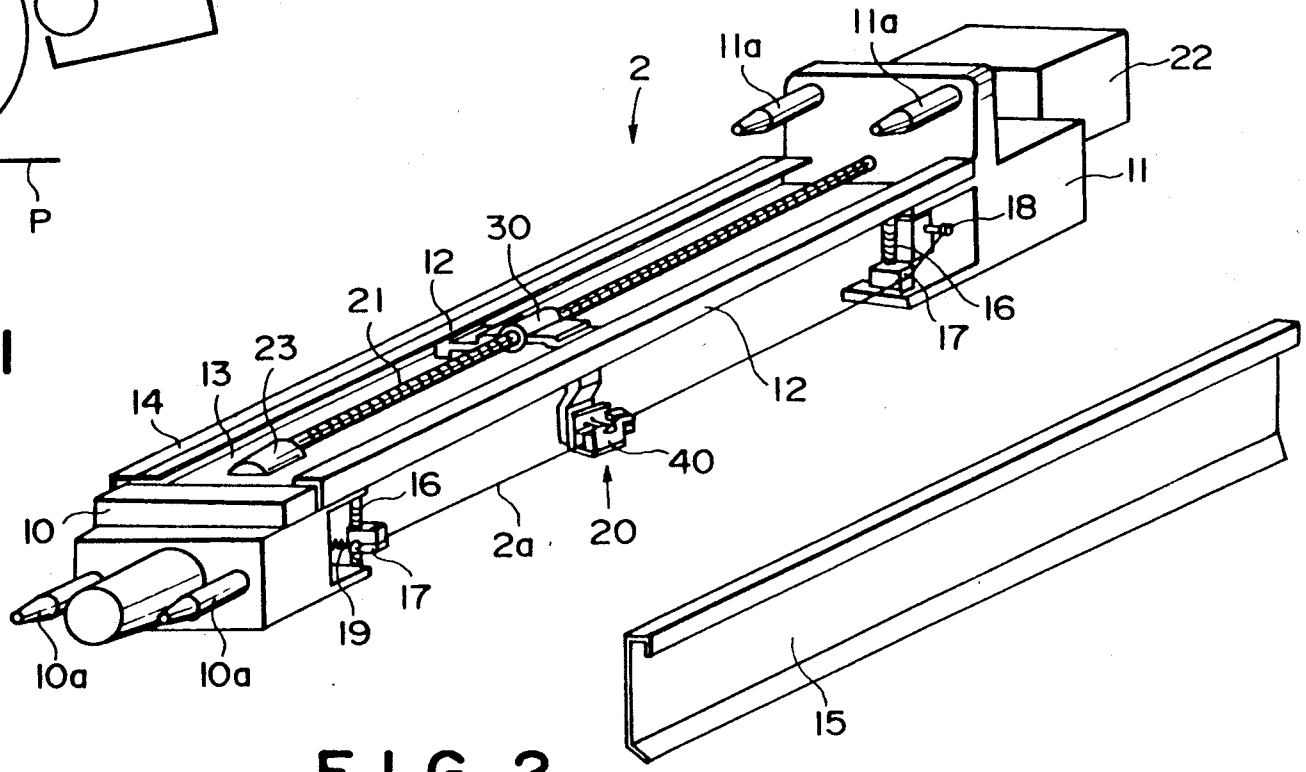
FIG. 2 is a perspective view of a primary charger.

FIG. 2 is a perspective view of the primary charger 2. First of all, the body of the primary charger 2 and thereabout will be described. In the vicinity of both ends of the photosensitive drum 1 (FIG. 1), the primary charger 2 has front and rear charging blocks 10 and 11 (FIG. 2), upper portions of which are connected to each other by angle members 12 and a reinforcement plate 13. Further, both sides of the primary charger between the charging blocks 10 and 11 are covered by shield members 14 and 15. Thus, the primary charger 2 has a laid U-shaped cross-section having an opening directing toward the photosensitive drum 1. In the interior of the laid U-shaped space between the front and rear charging blocks 10 and 11, a pair of corona wires 2*a* (only one of which is shown in FIG. 2) extend.

More specifically, the corona wires 2*a* extend between adjusting pieces 17 attached to the front and rear charging blocks 10, 11 through adjustment screws 16. One end of each corona wire is attached to a wire pin 18 formed on the rear charging block 11, and the other end of each corona wire is connected to a spring member 19 one end of which is attached to the front charging block 10, whereby a proper tension is applied to each corona wire. The adjusting pieces 17 can be moved in the up-and-down direction by rotating the respective adjustment screws 16, whereby the positions of the corona wires 2*a* can be adjusted with respect to the photosensitive drum 1. Incidentally, the reference numerals 10*a* and 11*a* denote positioning pins for positioning the primary charger 2 on the image forming system (copying machine).

Next, an automatic cleaning mechanism 20 for the corona wires 2*a* of the primary charger 2 will be explained. The automatic cleaning mechanism 20 comprises a rotatable ball screw shaft 21 disposed along the corona wires 2*a*, a holder 30 engaged by the rotatable shaft 21 and shiftable along the rotatable shaft in the left and right direction in response to the rotation of the rotatable shaft, cleaning portions 40 attached to the holder 30 and having cleaning members holding the respective corona wire therebetween, and a motor 22 for rotating the rotatable shaft 21.

The rotatable shaft 21 is disposed above the reinforcement plate 13. One end of the shaft 21 passes through the rear charging block 11 and is connected to a drive shaft of the motor 22, mounted on the rear charging block 11, and the other end of the shaft 21 is rotatably supported by the front charging block 10 through a bearing member 23.

Figures 3A, 3B, 3C:
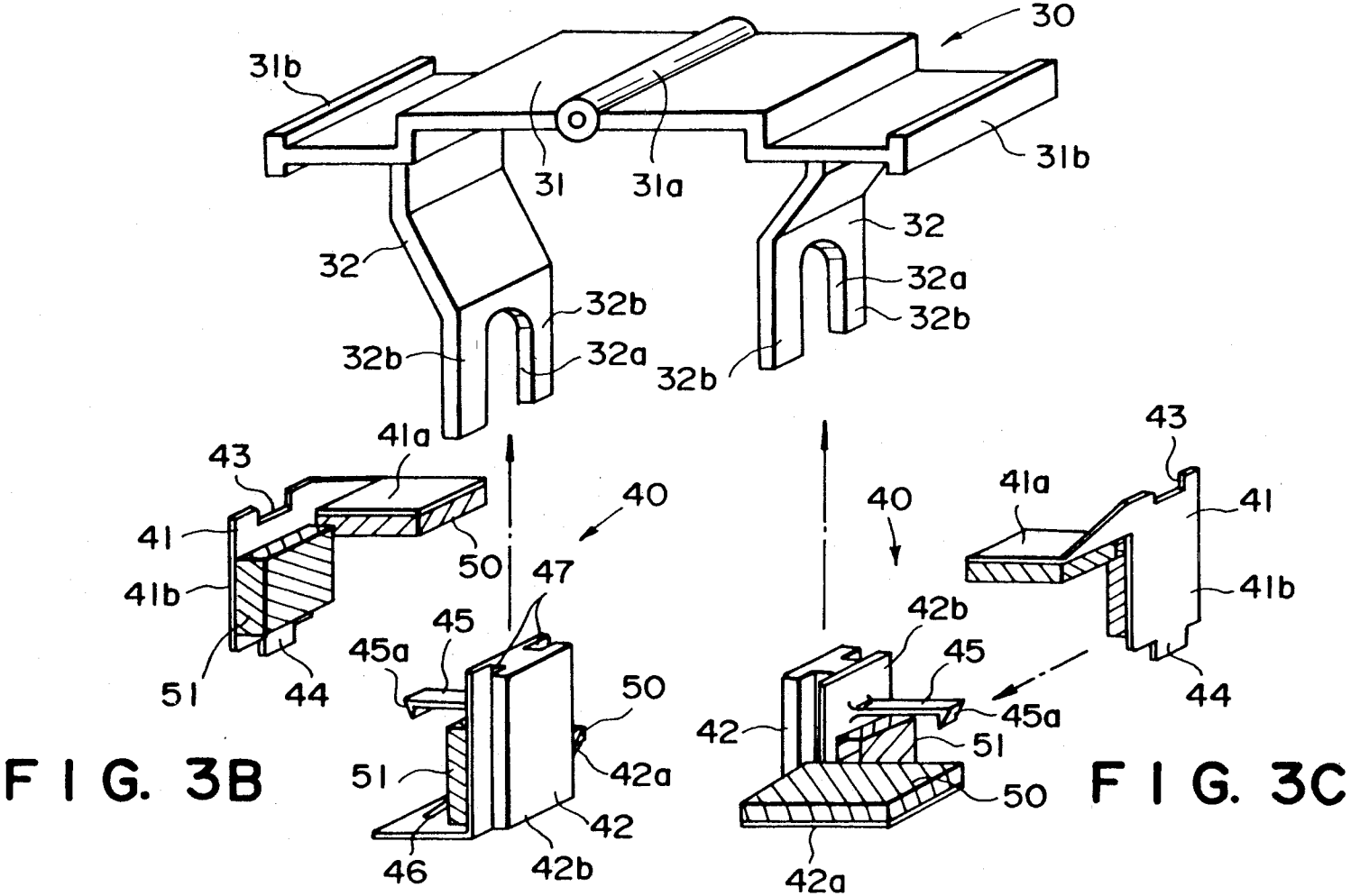
FIG. 3A is a perspective view of a holder of an automatic cleaning mechanism.
FIGS. 3B and 3C are exploded perspective views of cleaning portions of the automatic cleaning mechanism.
Figure 4:
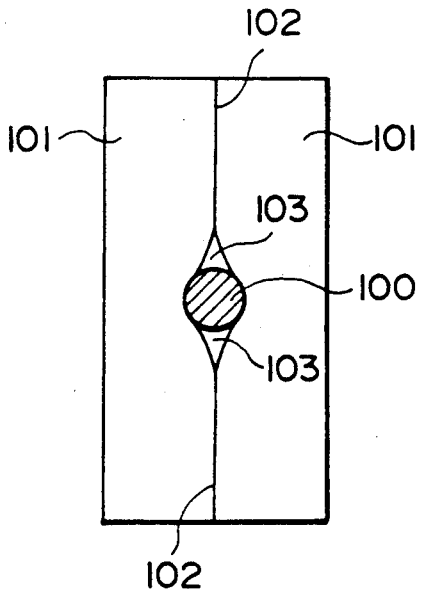
FIGS. 4, 5A and 5B are views for explaining a conventional technique.
Figure 5A:
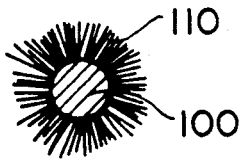
Figure 5B:
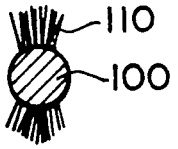

As shown in FIG. 3A, the holder 30 comprises a body portion 31 threadedly engaged by the rotatable shaft 21 and positioned horizontally on the reinforcement plate 13, and a pair of supporting portions 32 existing from the body portion 31 and adapted to position the cleaning members 40. The body portion 31 includes a central portion 31*a* threadedly engaged by the rotatable shaft 21 and side guide portions 31*b* guided and moved between the underlying reinforcement plate 13 and the overlying respective angle members 12. Each supporting portion 32 extends through a guide slit (not shown) formed in the reinforcement plate 13 toward the vicinity of the underlying respective corona wire 2*a* and is provided at its lower portion with a central U-shaped recess 32*a* defining guide arms 32*b* on both sides thereof for guiding the respective cleaning portion 40.

As shown in FIGS. 3B and 3C, the cleaning portion 40 includes left and right support plates 41, 42 having adjacent horizontal portions 41*a*, 42*a* and vertical portions 41*b*, 42*b*, respectively, and two pairs of cleaning members 50, 51 made of chloroprene rubber or silicone rubber having anti-ozone feature and attached to the horizontal portions 41*a*, 42*a* and the vertical portions 41*b*, 42*b* of the support plates 41, 42, respectively. The horizontal portions 41*a* and 42*a* of the support plate 41, 42 can be overlapped with each other; similarly, the vertical portions 41*b* and 42*b* of the support plates can also be overlapped with each other, so that the cleaning members 50 attached to the horizontal portions 41*a*, 42*a* are overlapped with each other and the cleaning members 51 attached to the vertical portions 41*b*, 42*b* are overlapped with each other.

The vertical portion 41*b* of the left support plate 41 has a supporting recess 43 at its upper part and a positioning projection 44 at its lower part, and the vertical portion 42*b* of the right support plate 42 has a corresponding holding lug 45 at its upper part and a corresponding positioning slot 46 at its lower part. The holding lug 45 extends horizontally from the vertical portion 42*b* and is provided at its free end with a locking pawl 45*a* for cooperating with the supporting recess 43 of the left support plate 41 to hold the left and right support plates 41, 42 in the overlapped condition. The positioning slot 46 is formed in a horizontal end plate formed on the lower end of the vertical portion 42*b*.

Further, the vertical portion 42*b* of the right support plate 42 has an H-shaped cross-section so that positioning grooves 47 are formed on both side edges thereof into which the guide arms 32*b* of the supporting portion 32 of the holder 30 can be slidably received. Thereby, only when the right support plates 41 or the left and right support plates 41 and 42 are held in the overlapped condition, are the left and right support plates 41 and 42 slidingly guided by the supporting portions 32 in the up-and-down direction.

The cleaning members 50 and 51 are made of elastic material to enclose the corona wires 2*a* adequately, and are attached to the left and right support plates 41 and 42 by double-sided adhesive tapes and the like. The cleaning members enclose the corona wire 2*a* from the left-and-right direction and from the up-and-down direction to clean the toner, oil mist, dust and the like adhered to the corona wire by slidingly shifting the cleaning members along the corona wire.

Incidentally, the two cleaning portions 40 are bisymmetrically attached to the corresponding supporting portions 32 of the holder 30 to clean the corresponding corona wires 2*a*. For simplifying the description, only one of the cleaning portions 40 will be fully explained hereinafter.

In order to attach the cleaning portion 40 to the holder 30, the left and right support plates 41 and 42 and integrally held in the overlapped condition so that the corona wire 2*a* is enclosed by the cleaning members 50 and 51 from the left-and-right direction and from the up-and-down direction, by inserting the positioning projection 44 into the positioning slot 46 and by engaging the locking pawl 45*a* of the holding lug 45 with the supporting recess 43. Thereafter, the guide arms 32*b* of the supporting portion 32 of the holder 30 are inserted into the positioning grooves 47 of the right support plate 42. In this way, the weight of the cleaning portion 40 is supported by the corona wire 2a, and the up-and-down movement of the cleaning portion 40 is guided by the supporting portion 32 of the holder 30. Further, the cleaning portion 40 can be shifted in the fore and aft direction in response to the fore and aft movement of the holder 30.

When stains have adhered to the corona wire 2a, after the image forming operations have been performed for a predetermined period, the motor 22 of the automatic cleaning mechanism 20 is energized to rotate the rotatable shaft 21. Consequently, the holder 30 is moved in the fore and aft direction, with the result that the cleaning portion 40 having the cleaning members 50 and 51 which are slidably enclosing the corona wire 2a, is also shifted in the fore and aft direction to clean the corona wire 2a. In this case, since the corona wire 2a is enclosed by the cleaning members 50 and 51 from the left-and-right direction and from the up-and-down direction, the whole peripheral surface of the corona wire 2a is cleaned evenly.

After the cleaning operation is finished, the cleaning portion 40 is returned to a non-charging area in the vicinity of the front or rear charging block 10 or 11.

Incidentally, when the corona wire 2a is finely adjusted in the up-and-down direction with respect to the photosensitive drum 1 by means of the adjustment screws 16, since the cleaning portion 40 of the automatic cleaning mechanism 20 is shiftable in the up-and-down direction, such adjustment operation is not disturbed at all. Further, since the cleaning portion 40 can be easily removed from the corona wire 2a by separating the left and right support plates 41 and 42 from each other, the replacement and maintenance of the cleaning members 50 and 51 can easily be performed.

In the illustrated embodiment, while the cleaning members 50 and 51 which are enclosing the corona wire 2a from the left-and-right direction and from the up-and-down direction, were integrally attached to the left and right support plates 41 and 42, the cleaning members enclosing the corona wire from the up-and-down direction and the cleaning members enclosing the corona wire from the left-and-right direction may be separately attached to discrete support plates and then such support plates may be attached to the supporting portion of the holder 30.

Further, while the invention was described in connection with the automatic cleaning mechanism 20 for the corona wires 2a of the primary charger 2, the present invention can be applied to the transfer charger 4 and a separating charger having the same construction.

In the illustrated embodiment, since each corona wire is enclosed by at least two sets of cleaning members disposed at a right angle with respect to each other, the peripheral surface of each corona wire can be evenly cleaned by two sets of cleaning members, thus eliminating the poor formation of the image due to the poor cleaning of the corona wires.

Figure 6A:
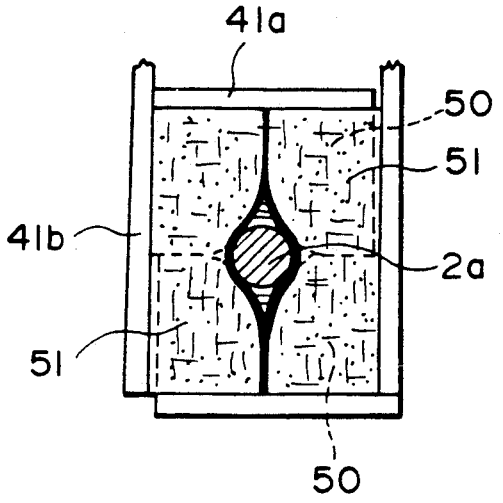
FIG. 6A is an elevational view showing a condition where a corona wire is slidingly held by cleaning members of a corona discharging apparatus according to an embodiment of the present invention.
Figure 6B:
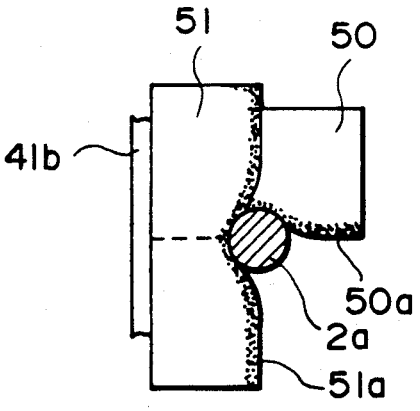
FIGS. 6B and 6C are development views showing each support member and the associated cleaning members.
Figure 6C:
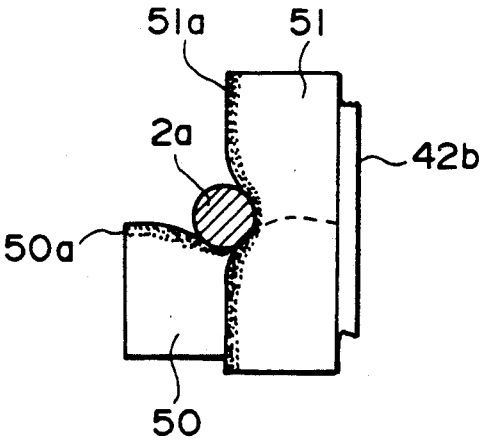

Further, wire abrasive layers (refer to FIGS. 6B and 6C) may be formed on the surfaces of the cleaning members 50 and 51 facing the corona wire, by painting epoxy resin blended with silicon carbide powder and the like having an abrasive ability on such surfaces.

In addition, the cleaning member may be made of foam rubber or solid rubber; in any case, it is desirable that the cleaning member can be elastically deformed so it is in slidable contact with the corona wire.

What is claimed is:

1. A corona discharging apparatus, comprising:

a corona discharge wire;

a support portion for spanning and supporting said corona discharge wire;

cleaning means contacting said corona discharge wire along the spanning direction of said corona discharge wire for cleaning said corona discharge wire, said cleaning means comprising a pair of first cleaning members and a pair of second cleaning member, wherein cleaning surfaces of said first pair of cleaning members form an angle with respect to said cleaning surfaces of said second pair of cleaning members, the corona discharge wire being nipped at said angle, when viewed in a cross section of said corona discharge wire, between at least one of said pair of first cleaning members and at least one of said pair of second cleaning members, the other of each respective pairs of cleaning members engaging said corona discharge wire when one of each respective pairs of cleaning members nips said corona discharge wire.

2. A corona discharge apparatus according to claim 1, wherein said cleaning surfaces of said first cleaning members and said cleaning surfaces of said second cleaning members are disposed at different positions along the spanning direction of said corona discharge wire.

3. A corona discharge apparatus according to claim 2, wherein said cleaning surfaces of said first and second cleaning members are positioned in proximity to the spanning direction of said corona discharge wire.

4. A corona discharge apparatus according to claim 1, wherein said cleaning surfaces of said first cleaning members form a substantially right angle with said cleaning surfaces of said second cleaning members.

5. A corona discharge apparatus according to claim 4, further comprising a first support member for supporting one of said first cleaning members and one of said second cleaning members in an L-shaped fashion, and s second support member for supporting the other of said first cleaning members and the other of said second cleaning members in an L-shaped fashion.

6. A corona discharge apparatus according to claim 5, wherein said first and second support members are removably attached to each other.

7. A corona discharge apparatus according to claim 5, further comprising shift means for shifting said first and second cleaning members in the spanning direction of said corona discharge wire while being supported by said first and second support members, said shift means being removably engaged with said first and second support members.

8. A corona discharge apparatus according to claim 1, further comprising a first support member for supporting one of said first cleaning members and one of said second cleaning members, and a second support member for supporting the other of said first cleaning members and the other of said second cleaning members.

9. A corona discharge apparatus according to claim 8, wherein said first and second support members are removably attached to each other.

10. A corona discharge apparatus according to claim 8, further comprising shift means for shifting said first and second cleaning members in the spanning direction of said corona discharge wire while being supported by said first and second support members, said shift means being removably engaged with said first and second support members.

11. A corona discharge apparatus according to claim 11, further comprising drive means for applying a drive force for shifting said first and second cleaning members in the spanning direction of said corona discharge wire.

12. A corona discharge apparatus according to claim 1, wherein said cleaning surfaces of said first and second cleaning members are composed of a grinding agent.

13. A corona discharge apparatus according to claim 1, further comprising a support member for supporting said first and second cleaning members.

14. A corona discharge apparatus according to claim 13, further comprising shift means for shifting said first and second cleaning members in the spanning direction of said corona discharge wire while being supported by said support member, said shift means being removably engaged with said support member.

15. A corona discharge apparatus according to claim 1, wherein said corona discharging apparatus comprises means for applying a corona discharge toward a photosensitive member.

16. A corona discharge apparatus according to claim 15, wherein said corona discharging apparatus comprises means for performing corona discharge in an image forming apparatus.

17. A corona discharge apparatus according to claim 1, wherein said corona discharging apparatus comprises means for performing corona discharge in an image forming apparatus.

18. A corona discharging apparatus, comprising:

a corona discharge wire;

a support portion for spanning and supporting said corona discharge wire; and cleaning means contacting said corona discharge wire in the spanning direction of said corona discharge wire for cleaning said corona discharge wire, said cleaning means having a cleaning member comprising four cleaning surfaces, each cleaning surface being engageable with said wire and extending along the length of said wire and each of said four cleaning surfaces being offset at substantially right angles, when viewed in a cross section of said corona discharge wire.

19. A corona discharge apparatus according to claim 18, further comprising a first support member for supporting the cleaning member having two of said four cleaning surfaces being offset at a substantially right angle, when viewed in a cross section of said corona discharge wire, and a second support member for supporting the cleaning member including the two remaining cleaning surfaces.

20. A corona discharge apparatus according to claim 18, wherein said first and second support members are removably attached to each other.

21. A corona discharge apparatus according to claim 19, further comprising shift means for shifting said cleaning member in the spanning direction of said corona discharge wire while being supported by said first and second support members, said shift means being removably engaged with said first and second support members.

22. A corona discharge apparatus according to claim 18, further comprising drive means for applying a drive force for shifting said cleaning member in the spanning direction of said corona discharge wire.

23. A corona discharge apparatus according to claim 18, wherein said cleaning surfaces of said cleaning member are composed of a grinding agent.

24. A corona discharge apparatus according to claim 18, further comprising a support member for supporting said cleaning member.

25. A corona discharge apparatus according to claim 24, further comprising shift means for shifting said cleaning member in the spanning direction of said corona discharge wire while being supported by said first and second support members, said shift means being removably engaged with said first and second support members.

26. A corona discharge apparatus according to claim 18, wherein said corona discharging apparatus comprises means for applying a corona discharge toward a photosensitive member.

27. A corona discharge apparatus according to claim 26, wherein said corona discharging apparatus comprises means for performing corona discharge in an image forming apparatus.

28. A corona discharge apparatus according to claim 18, wherein said corona discharging apparatus comprises means for performing corona discharge in an image forming apparatus.

* * * * *

UNITED STATES PATENT AND TRADEMARK OFFICE

CERTIFICATE OF CORRECTION

PATENT NO. : 5,182,694

DATED : January 26, 1993

INVENTOR(S) : MICHIAKI ENDO

It is certified that error appears in the above-identified patent and that said Letters Patent is hereby corrected as shown below:

COLUMN 1

Line 10, "the" should be deleted.
Line 11, "and" should read --and the--.
Line 15, "primary" should read --a primary--.
Line 26, "mist" should read --mist,--.

COLUMN 2

Line 37, "drum 1" should read --drum 1,--.

COLUMN 3

Line 58, "existing" should read --extending--.

COLUMN 4

Line 58, "and" (third occurrence) should read --are--.

COLUMN 5

Line 13, "51" should read --51,--.
Line 36, "51" should read --51,--.
Line 68, "discharging" should read --discharge--.

COLUMN 6

Line 9, "member," should read --members,--.
Line 38, "s" should read --a--.

UNITED STATES PATENT AND TRADEMARK OFFICE

CERTIFICATE OF CORRECTION

PATENT NO. : 5,182,694

DATED : January 26, 1993

INVENTOR(S) : MICHIAKI ENDO

It is certified that error appears in the above-identified patent and that said Letters Patent is hereby corrected as shown below:

COLUMN 7

Line 2, "11," should read --1,--.
Line 29, "discharging" should read --discharge--.

COLUMN 8

Line 7, "18," should read --19,--.

Signed and Sealed this

Twenty-sixth Day of July, 1994

Bruce Lehman

*Attest:*

BRUCE LEHMAN

*Attesting Officer*

*Commissioner of Patents and Trademarks*